US005702781A

United States Patent [19]

Barker

[11] Patent Number: 5,702,781

[45] Date of Patent: Dec. 30, 1997

[54] HANGING ORNAMENT FOR SIMULATING HUMAN MOVEMENT

[76] Inventor: Thomas Earl Barker, 5940 Bishop Dale, Memphis, Tenn. 38115

[21] Appl. No.: 529,027

[22] Filed: Sep. 15, 1995

[51] Int. Cl.[6] ..... A63H 3/00

[52] U.S. Cl. ..... 428/16; 40/617; 446/491

[58] Field of Search ..... 428/7, 16; 40/617; 446/491

[56] References Cited

U.S. PATENT DOCUMENTS

| | | | |
|---|---|---|---|
| 1,981,696 | 11/1934 | Harper | 428/7 X |
| 3,195,265 | 7/1965 | Marquez et al. | 428/16 X |
| 3,874,113 | 4/1975 | Beck | 446/378 |
| 4,239,825 | 12/1980 | Kaulfuss et al. | 428/16 |
| 4,381,618 | 5/1983 | Krisel | 428/16 X |
| 4,939,004 | 7/1990 | Fuss | 428/9 |
| 5,116,648 | 5/1992 | Martin et al. | 428/7 |
| 5,393,075 | 2/1995 | Harber | 273/459 |

*Primary Examiner*—Henry F. Epstein
*Attorney, Agent, or Firm*—Walker, McKenzie & Walker, P.C.

[57] ABSTRACT

An ornament for hanging from a support, such as a Christmas tree. The ornament includes a body portion and a headpiece portion. The headpiece portion is supported above the body portion and both portions are suspended from a support. The headpiece can be configured to represent a helmet or a cap. Alternatively, the headpiece can resemble the face of a sports personality. The body portion comprises a torso portion and a leg portion which is suspended from the torso portion. The headpiece, torso and leg portions are connected together to allow for movement in a way that simulates human action. Additionally the headpiece, torso and leg portions can depict an athletic uniform.

8 Claims, 2 Drawing Sheets

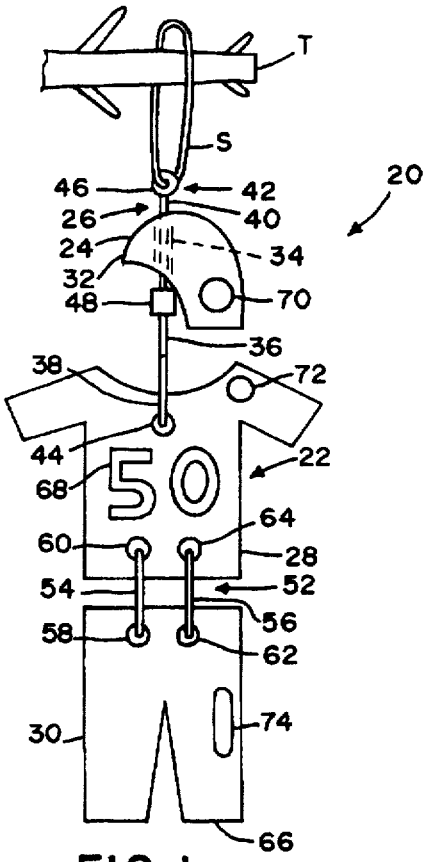
FIG. 1
FIG. 2
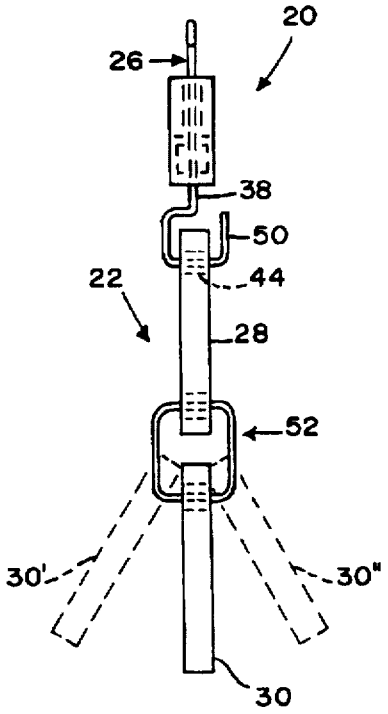
FIG. 3
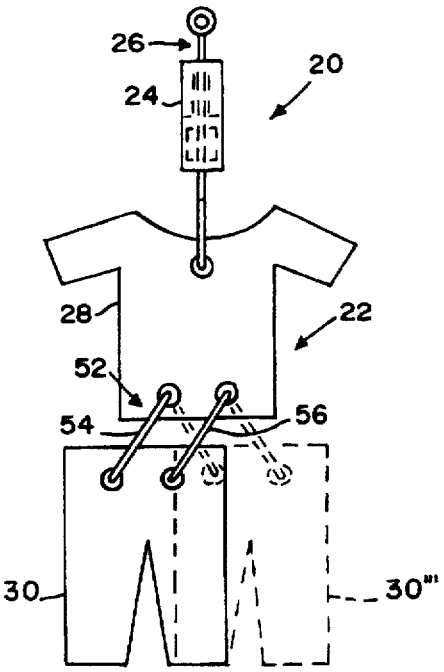
FIG. 4
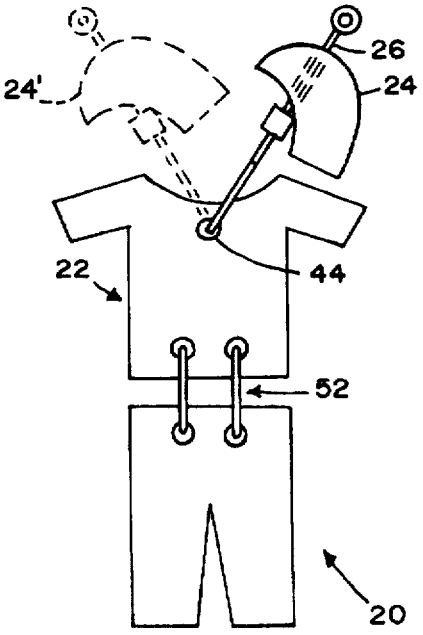

HANGING ORNAMENT FOR SIMULATING HUMAN MOVEMENT

BACKGROUND OF THE INVENTION

1. Field of the Invention

The present invention relates, in general, to, an ornament hanging from a support, and in particular, to a Christmas tree ornament representing an athlete and able to move to simulate human action.

2. Information Disclosure Statement

Sports enthusiasts often desire to show support for a favorite sport, athletic team or player. Posters, t-shirts, and caps are common objects which allow a fan to express such support.

Christmas tree ornaments in the shape of a human are well known in the art. Common examples are cookies baked in human shapes and suspended from a Christmas tree. While there is much prior art concerning ornaments in the shape of a human hanging from a support, none of the prior art discloses an ornament representing an athlete, and allowing for movement of a torso, a pair of legs, and a headpiece with a cap or a helmet, in a way to simulate human movement.

A preliminary patentability search in Class 428, subclasses 7 and 11; and Design Class 11, subclasses 117 and 118, produced the following patents, some of which may be relevant to the present invention: Harber, U.S. Pat. No. 5,393,075, issued Feb. 28, 1995; Martin et al, U.S. Pat. No. 5,116,648, issued May 26, 1992; Harper, U.S. Pat. No. 1,981,696, issued Nov. 20, 1934; and Fuss, U.S. Pat. No. 4,939,004, issued Jul. 3, 1990.

SUMMARY OF THE INVENTION

The present invention is an ornament capable of hanging from a support, such as a Christmas tree branch. The ornament includes a torso, a pair of legs, a uniform, and a headpiece, which may include a helmet or a cap. The headpiece is capable of rotation about a vertical axis with respect to the torso and is also capable of pivoting in an angular direction toward and away from each side of the torso portion. The legs are capable of hinged movement, front wards and rearwards, and of lateral movement with respect to the torso.

It is an object of the present invention to provide an ornament which will allow sports fans to express their support for a particular sport, athlete or athletic team.

It is an additional object of the present invention to provide an ornament which will hang from a support, represent an athlete, and which will simulate human movement.

BRIEF DESCRIPTION OF THE DRAWINGS

FIG. 1 is a front view of the present invention.

FIG. 2 is a side view of the present invention showing hinged movement of the leg portion with respect to the torso portion.

FIG. 3 is a front view of the present invention showing the headpiece portion rotated 90 degrees with respect to the body portion, and showing lateral movement of the leg portion with respect to the torso portion.

FIG. 4 is a front view of the present invention showing angular movement of the headpiece portion with respect to the torso portion.

DESCRIPTION OF THE PREFERRED EMBODIMENT

Figure 5:
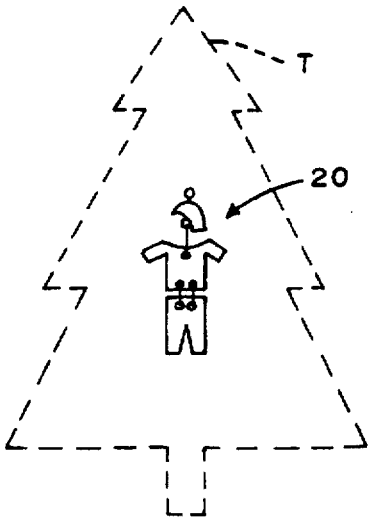
FIG. 5 is a view of the environment of the present invention, shown hanging from a Christmas tree branch.

Referring to FIGS. 1–8, ornament 20 is seen to comprise a body portion 22, a headpiece portion 24, and hanging means 26 for hanging the body portion 22 from a support, such as Christmas tree T. Hanging means 26 is also for mounting the headpiece portion 24 above the body portion 22. It shall be understood that the term "headpiece portion", as used herein, is to be broadly interpreted, and that headpiece portion 24 may include a helmet portion 32 as shown in FIG. 1, or in alternate embodiments may have a head only without a helmet portion 32, as shown, for example, in FIG. 8, hereinafter described. The headpiece portion 24 may represent the face of an athlete or sports personality. It shall also be understood that the term "helmet portion" is not limited to a helmet, but may include a cap, a face mask, or any other headgear worn by an athlete or sports personality. The body portion 22 may comprise a torso portion 28 and a leg portion 30, with the leg portion 30 hingeably attached to the torso portion 28.

As shown in FIGS. 1 and 2, hanging means 26 may include an elongated securing tiepiece 36, preferably a wire, having a first end 38 and a second end 40. The first end 38 is secured to the body portion 22 and the second end 40 has securing means 42 for securing the ornament 20 to a support, such as Christmas tree T, shown in FIG. 5. The elongated securing tiepiece 36 passes through a bore 34 through the headpiece portion 24. The bore 34 defines a longitudinal bore, which penetrates through the entire longitudinal vertical center axis of the headpiece portion 24.

In this specification, it is understood that the term "wire" is not limited to conductive or metallic wires, but includes any linear support member capable of holding the object. For example, the elongated securing tiepiece 36, preferably a wire, could be made of a suitable plastics material or of any suitable fibrous material or string.

The first end 38 of elongated securing tiepiece 36 preferably includes a hook 50 for passing through a suspension hole 44 in the body portion 22, as shown in FIGS. 1 and 2. The suspension hole 44 defines a third transverse suspension hole in the torso portion 28. The second end 40 of the elongated securing tiepiece 36 preferably has a loop 46 for securing to a support, such as Christmas tree T as, for example, by a string S. Hanging means 26 may include a sleeve 48, encircling the elongated securing tiepiece 36 beneath the headpiece portion 24 and upon which the headpiece portion 24 rests, with sleeve 48 preferably frictionally secured to the elongated securing tiepiece 36.

The headpiece portion 24 may be rotatably mounted by hanging means 26 so that the headpiece portion 24 may rotate about a vertical axis, with respect to the body portion 22, as shown in FIG. 3, with the headpiece portion 24 shown rotated, for example, 90 degrees with respect to the body portion 22. Additionally or alternatively, the headpiece portion 24 may be pivotally mounted by hanging means 26 so that the headpiece portion 24 may move angularly with respect to the body portion 22, as shown in FIG. 4.

Leg portion 30 may have a first transverse suspension hole 58 and a second transverse suspension hole 62. Ornament 20 may include hinge means 52 for suspending the leg portion 30 from the torso portion 28 so that the leg portion 30 may move hingedly and laterally with respect to the torso portion 28. FIG. 2 shows hinged movement of the leg portion 30 with respect to the torso portion 28. Dotted positions 30' and 30" show hinged movement of the leg portion 30 towards the front and back of the torso portion 28, while the solid portion shows the normal resting position of the leg portion 30. FIG. 3 shows lateral movement of the leg portion 30 with respect to the torso portion 28. The leg portion 30 drawn in a solid line shows lateral movement in one direction, while the leg portion 30'" drawn in a dashed line shows lateral movement in the other direction. Hinge means 52 comprises a first wire 54 and a second wire 56 with first wire 54 passing through the first transverse suspension hole 58 and through the first transverse support hole 60, and with second wire 56 passing through the second transverse suspension hole 62 and through the second transverse support hole 64.

Hanging means 26 and the hinge means 52 allow the headpiece 24, torso 28, and leg 30 portions to move in a way that simulates human action. Movement can occur when the support is acted upon, or when the headpiece 24, torso 28, or leg 30 portions are acted upon, either manually or by air motion.

The helmet portion 252, the torso portion 28, and the leg portion 30, may depict an athletic uniform by having numerals 68 and team logos 70, 72, and 74 as shown in FIG. 1. The numerals 68 and team logos 70, 72, and 74 can be engraved, painted, molded, or sewn onto the respective portions.

Figure 6:
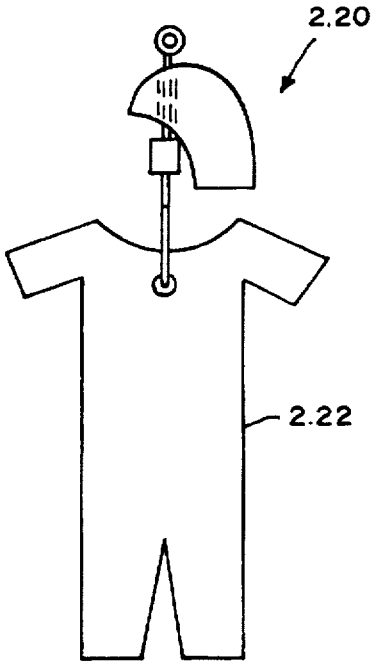
FIG. 6 is a view of a second embodiment of the present invention, showing a headpiece portion and a body portion.

A second embodiment of the present invention is shown in FIG. 6. Identifying reference designators are marked similarly to the first embodiment, except with the prefix "2" It shall be understood that many aspects of the two embodiments are substantially the same, and only the differences will be treated in detail, it being understood that similar structural features of all the embodiments perform similar functions. The second embodiment includes a one piece body portion 2.22.

Figure 7:
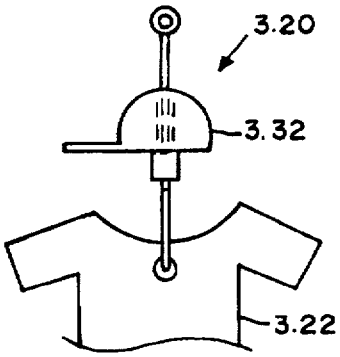
FIG. 7 is a fragmentary view of a third embodiment of the present invention, showing the headpiece portion including a cap.

A third embodiment of the present invention is shown in FIG. 7. Identifying reference designators are marked similarly to the first embodiment, except with the prefix "3" It shall be understood that many aspects of the two embodiments are substantially the same, and only the differences will be treated in detail, it being understood that similar structural features of all the embodiments perform similar functions. In the third embodiment, the helmet portion 3.32 is constructed in the shape of a cap.

Figure 8:
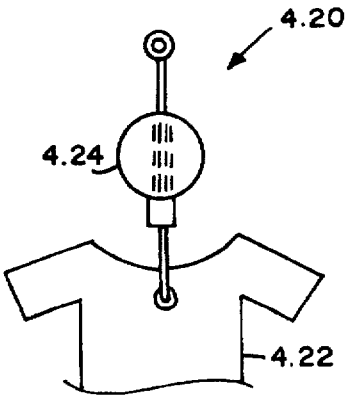
FIG. 8 is a fragmentary view of a fourth embodiment of the present invention, showing the headpiece portion representing the face of a sports personality without a cap.

A fourth embodiment of the present invention is shown in FIG. 8. Identifying reference designators are marked similarly to the first embodiment, except with the prefix "4" It shall be understood that many aspects of the two embodiments are substantially the same, and only the differences will be treated in detail, it being understood that similar structural features of all the embodiments perform similar functions. In the fourth embodiment, headpiece portion 4.24 is constructed to resemble the face of an athlete or sports personality.

The ornament 20 can be constructed in various sizes and out of various materials, as will now be apparent to those skilled in the art. The body portion 22 and the headpiece portion 24 can be stamped, cut or molded from colored compounds, plastics, resins, wood, or any other suitable material. The body portion 22 and the headpiece portion 24 are preferably constructed from synthetic resin materials sold under the trademark "PLEXIGLAS". The dimensions and thickness of ornament 20 are chosen so that the weight of ornament 20 can be supported by a branch of a Christmas tree T. The depth of the body portion 22 and the headpiece portion 24 is preferably ⅛ to ¼ inch (3.18 to 6.35 mm) thick. The preferable height is 4 inches (10.16 cm) from the bottom edge 66 of the body portion 22 to the loop 46 for securing to a support such as Christmas tree T, while the preferable width is 2.5 inches (6.35 cm) between the furthest points of the body portion 22.

Although the present invention has been described and illustrated with respect to a preferred embodiment and a preferred use therefor, it is not to be so limited since modifications and changes can be made therein which are within the full intended scope of the invention.

I claim:

1. An ornament for hanging from a support, said ornament comprising;

(a) a body portion;

(b) a headpiece portion, said headpiece portion having a longitudinal bore therethrough; and (c) hanging means for hanging said body portion from the support and for mounting said headpiece portion above said body portion, said hanging means including an elongated securing tiepiece having first and second ends, said first end being secured to said body portion, said second end having securing means for securing said ornament to said support, said tiepiece passing through said bore through said headpiece portion.

2. The ornament as recited in claim 1, in which said tiepiece is a wire.

3. The ornament as recited in claim 1, in which said tiepiece is a string.

4. An ornament for hanging from a support, said ornament comprising:

(a) a body portion, said body portion having a suspension hole therethrough;

(b) a headpiece portion, said headpiece portion having a longitudinal bore therethrough; and (c) hanging means for hanging said body portion from the support and for mounting said headpiece portion above said body portion, said hanging means comprising an elongated securing tiepiece; said elongated securing tiepiece comprising a wire passing through said bore through said headpiece portion; said wire having a first and a second end; said first end including a hook for passing through said suspension hole in said body portion; and said second end having a loop for securing to said support.

5. The ornament as recited in claim 4, in which said hanging means includes a sleeve encircling said wire beneath said headpiece portion and upon which said headpiece portion rests.

6. An ornament for hanging from a support, said ornament comprising:

(a) a body portion;

(b) a headpiece portion; and (c) hanging means for hanging said body portion from the support and for mounting said headpiece portion above said body portion, said headpiece portion being rotatably mounted to said body portion by said hanging means so that said headpiece portion may rotate about a vertical axis with respect to said body portion.

7. An ornament for hanging from a support, said ornament comprising:

(a) a body portion;

(b) a headpiece portion; and (c) hanging means for hanging said body portion from the support and for mounting said headpiece portion above said body portion.

said headpiece portion being pivotally mounted by said hanging means so that said headpiece portion may move angularly with respect to said body portion, and said headpiece portion being rotatably mounted to said body portion by said hanging means so that said headpiece portion may rotate about a vertical axis with respect to said body portion.

8. An ornament for hanging from a support, said ornament comprising:

(a) a helmet portion having a longitudinal bore therethrough;

(b) a body portion comprising a leg portion and a torso portion; said leg portion having first and second transverse suspension holes; said torso portion having a third transverse suspension hole, and first and second transverse support holes;

(c) hinge means for suspending said leg portion from said torso portion so that said leg portion may move hingedly and laterally with respect to said torso portion; said hinge means comprising first and second wires; said first wire passing through said first transverse suspension hole and said first transverse support hole; said second wire passing through said second transverse suspension hole and said second transverse support hole; and (d) hanging means for hanging said torso portion from the support, for pivotally mounting said helmet portion above said torso portion so that said helmet portion may move angularly with respect to said body portion, and for rotatably mounting said helmet portion so that said helmet portion may rotate about a vertical axis with respect to said torso portion; said hanging means including an elongated securing tiepiece having first and second ends and passing through said longitudinal bore through said helmet portion; said first end having a hook passing through said third transverse suspension hole in said torso portion; said second end having a loop for securing to said support; said elongated securing tiepiece comprising a wire; and said hanging means including a sleeve encircling said wire beneath said helmet portion and upon which said helmet portion rests.

* * * * *